US011230851B2

(12) United States Patent
Ubiñana Felix

(10) Patent No.: US 11,230,851 B2
(45) Date of Patent: Jan. 25, 2022

(54) HEAD FOR A PROP

(71) Applicant: SISTEMAS TECNICOS DE ENCOFRADOS, S.A., Parets del Valles (ES)

(72) Inventor: Jose Luis Ubiñana Felix, Parets del Valles (ES)

(73) Assignee: SISTEMAS TECNICOS DE ENCOFRADOS, S.A., Parets del Valles (ES)

( * ) Notice: Subject to any disclaimer, the term of this patent is extended or adjusted under 35 U.S.C. 154(b) by 148 days.

(21) Appl. No.: 16/481,433

(22) PCT Filed: Jan. 22, 2018

(86) PCT No.: PCT/ES2018/070046
§ 371 (c)(1),
(2) Date: Jul. 26, 2019

(87) PCT Pub. No.: WO2018/142004
PCT Pub. Date: Aug. 9, 2018

(65) Prior Publication Data

US 2020/0115912 A1 Apr. 16, 2020

(30) Foreign Application Priority Data

Feb. 3, 2017 (ES) ..... ES201730128

(51) Int. Cl.
*E04G 11/48* (2006.01)
*E04G 11/50* (2006.01)

(52) U.S. Cl.
CPC ..... *E04G 11/483* (2013.01); *E04G 11/50* (2013.01)

(58) Field of Classification Search
USPC ..... 248/228.1, 228.6, 228.5, 235, 239, 247, 248/248; 52/127.2, 651.07, 651.1;
(Continued)

(56) References Cited

U.S. PATENT DOCUMENTS 10,053,875 B1 * 8/2018 Baron ..... E04G 11/38
10,883,283 B2 * 1/2021 Faresin ..... E04G 11/50
(Continued)

FOREIGN PATENT DOCUMENTS

CA 2988166 A1 * 3/2019 ..... E04G 11/50
CN 201190418 Y 2/2009
(Continued)

OTHER PUBLICATIONS

Spanish Search Report for Application No. 201730128, dated May 8, 2017 in 4 pages.
(Continued)

*Primary Examiner* — Alfred J Wujciak
(74) *Attorney, Agent, or Firm* — Knobbe, Martens, Olson & Bear, LLP

(57) ABSTRACT

The invention relates to a head for a formwork prop, which comprises a lower pin for connecting to the prop, a base for supporting beams, and four projections arranged to form a rectangle defining a long side and a short side, each projection being disposed at a corner of said rectangle, the rectangle delimiting an area for receiving beams. The head comprises two plates perpendicular to the support base, the plates being arranged parallel to each other and to the long side such that the plates leave a space therebetween for a beam and respective spaces for a beam in the space between the ends of the plates and one of the projections, each plate comprising at least two housings for attaching a beam.

12 Claims, 12 Drawing Sheets

(58) Field of Classification Search
USPC ..... 249/18, 26, 28, 210, 27
See application file for complete search history.

(56) References Cited

U.S. PATENT DOCUMENTS

| | | | | |
|---|---|---|---|---|
| 2019/0010716 | A1* | 1/2019 | Baron | E04G 25/065 |
| 2019/0277044 | A1* | 9/2019 | Faresin | E04G 11/50 |

FOREIGN PATENT DOCUMENTS

| | | | | |
|---|---|---|---|---|
| CN | 203334658 | U | 12/2013 | |
| CN | 106103864 | A | 11/2016 | |
| DE | 102015223773 | A1 * | 6/2017 | E04G 11/38 |
| EP | 1384837 | A1 | 1/2004 | |
| EP | 2044273 | A1 | 4/2009 | |
| EP | 3202998 | A1 * | 8/2017 | E04G 11/38 |
| ES | 8607459 | A1 | 11/1986 | |
| ES | 2143377 | A1 | 5/2000 | |
| FR | 2965286 | A1 | 3/2012 | |
| JP | H07207934 | A | 8/1995 | |
| JP | 2014080749 | A | 5/2014 | |
| KR | 101570677 | B1 | 11/2015 | |
| WO | 2008/020138 | A1 | 2/2008 | |
| WO | 2015196264 | A1 | 12/2015 | |
| WO | WO-2015196264 | A1 * | 12/2015 | E04G 11/50 |
| WO | WO-2017093233 | A1 * | 6/2017 | E04G 17/005 |

OTHER PUBLICATIONS

International Search Report and Written Opinion for PCT Application No. PCT/ES2018/070046, dated Jun. 7, 2018 in 11 pages.
Search Report for Chinese Patent Application No. 201880009420.2, dated Dec. 3, 2020 in 5 pages.
Supplementary European Search Report for European Patent Application No. EP18747497.8, dated Oct. 26, 2020 in 61 pages.

* cited by examiner

HEAD FOR A PROP

CROSS-REFERENCE TO RELATED APPLICATIONS

This application is the U.S. National Phase under 35. U.S.C. § 371 of International Application PCT/ES2018/070046, filed Jan. 22, 2018, which claims priority to Spanish Patent Application No. P201730128, filed Feb. 3, 2017. The disclosures of the above-described applications are hereby incorporated by reference in their entirety.

FIELD OF THE INVENTION

The present invention relates to formwork systems that include a series of beams supported on props by means of a head, more specifically on said head.

SUMMARY OF THE INVENTION

More specifically, the present invention relates to a head that allows the beams to be connected in accordance with a plurality of configurations.

Heads of this type, comprising a lower pin for connecting to the prop, a support base for beams and four projections which project perpendicularly to the base and which delimit the region for positioning the beams, are known. The support base consists of a quadrangular plate and each of the projections is located in one of the corners of the plate. This arrangement allows a beam passing longitudinally (i.e. the direction of the long side of the rectangle) or two parallel beams crossing the head transversely (i.e. in a direction parallel to the short side of the rectangle) to be accommodated. This head requires other connection pieces in order to ensure the connection in each of the different configurations. As a consequence of the need to assemble and disassemble different connection pieces, the durability of this type of head is limited.

It is an object of the present invention to disclose a head for a prop for formwork systems which does not have the aforementioned drawbacks.

This is achieved by means of two plates perpendicular to the base which are arranged in parallel with one another and in parallel with the long side in such a way that they leave a space for a beam between plates and leave a space for a beam in each case in the space between the ends of the plates and one of the projections, each plate having at least two receptacles for securing beams.

The present invention discloses the combination of a basic known head structure together with the use of plates having receptacles for the ends of the formwork beams. The result is a cost-effective and durable head which allows a plurality of formwork configurations without requiring other types of heads or connection pieces.

More specifically, the present invention discloses a head for a formwork prop, comprising a lower pin for connecting to the prop, a support base for beams and four projections arranged so as to form a rectangle that defines a long side and a short side, in which each projection is arranged in a corner of the rectangle, said rectangle delimiting the beam-receiving region. The head comprises two plates perpendicular to the support base, the plates being arranged in parallel with one another and in parallel with the long side in such a way that they leave a space for a beam between plates and leave a space for a beam in each case in the space between the ends of the plates and one of the projections, each plate having at least two receptacles for securing beams.

Preferably, each receptacle in each of the plates is aligned with another receptacle in the parallel plate, along a line that is parallel to the short side.

More preferably, the receptacles are located in the upper edge of the plates. Even more preferably, the receptacles are arranged symmetrically with respect to the centre of the rectangle.

Advantageously, the head comprises a base plate which constitutes the support base and to which the plates are connected. Even more advantageously, the head comprises a bent sheet which constitutes the parallel plates and the base plate.

In a particularly advantageous embodiment, the head comprises four bent rods which are connected to one another via one of the ends thereof and are separate and parallel to one another, one connected portion of rods constituting the pin and each of the separate and parallel ends constituting one of the projections.

The present invention also discloses a head for a prop according to the present invention.

The present invention also discloses a formwork system comprising at least one prop according to the present invention, or at least one head according to the present invention, and at least one beam situated in the beam-receiving region.

Preferably, the beam comprises at least one projection that couples with the receptacle or receptacles for securing beams. More preferably, the projection is cylindrical. Even more preferably, the beam comprises two projections, one on each side of the beam, the longitudinal axis of the cylinders of the two projections being aligned.

In preferred embodiments of the system according to the present invention, the receptacles are coupled with projections situated at one end of the beams, preferably cylindrical projections situated in the two lateral faces. The two projections can be formed by a simple cylindrical rod which passes through the profile of the beam via a through-hole. The position of the rod can be fixed by welding.

The head according to the invention provides a wide range of possible configurations, particularly in its preferred embodiments, including: positioning the head below a beam at any point along the length thereof, the head being situated at the end of the beam, preferably secured thereto, the head connecting two consecutive aligned beams, the head connecting two overlapping parallel beams, and the head connecting two beams at a right angle.

It should be noted that, according to a particularly preferred embodiment, the head is formed by four bent rods and a sheet that is cut and folded thereabove. The durability of this particular embodiment is far superior to those having heads of the known type, since, in contrast with the embodiments of the prior art, the rods provide rigidity to the whole, while the sheet is used to distribute the load without allowing high pressure points under the beam which would damage the lower part of the (typically wooden) beam. In turn, the flaps which are used to accommodate the ends of the beams are protected against impacts by the rods themselves.

BRIEF DESCRIPTION OF THE DRAWINGS

To aid understanding, explanatory yet non-limiting drawings of an embodiment of the method and device according to the present invention are included by way of example.

DETAILED DESCRIPTION OF THE PREFERRED EMBODIMENTS

Figure 1:
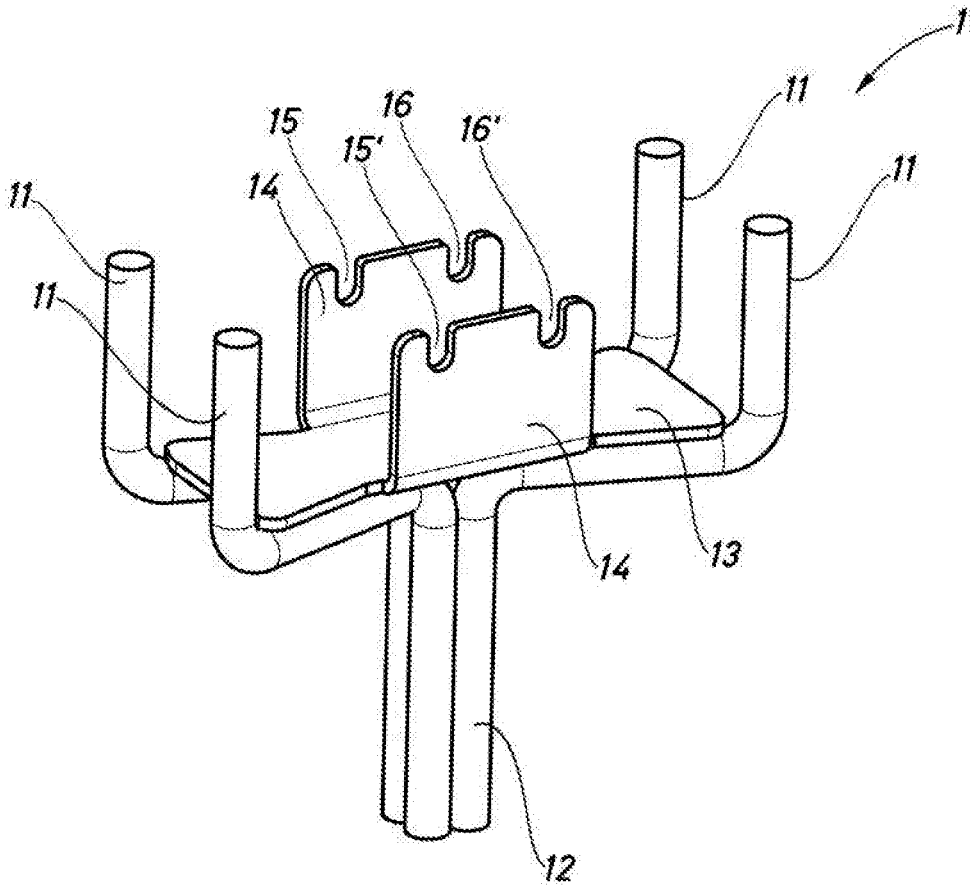
FIG. 1 is a perspective view of an exemplary embodiment of the head for a prop according to the present invention.

FIG. 1 shows an exemplary embodiment of the head -1- for a prop according to the present invention. FIGS. 2 to 12 show use examples of the exemplary head.

The terms "upper", "lower", "horizontal" and "vertical" in the elements of the head shown and in the following exemplary embodiments of the system according to the present invention are based on the most common use of the devices described in a formwork system, assuming that the beams are positioned so as to be horizontally supported on vertical points, within the possible and/or usual positioning tolerances within the field of construction.

The head -1- comprises four metal rods, in this case bent identically in the shape of the number "4", which are connected by one of the portions thereof so as to form a lower pin -12- for connecting to the prop. Said lower pin is to be introduced into a central hole of a prop, for example a standard prop (not shown in the drawings).

The lower pin -12- rounds off at the top in a bend of each of the rods that form the exemplary head shown, thus resulting in respective horizontal rod portions which lead away from the lower pin symmetrically with respect to one another so as to form a horizontal base upon which sits a bent sheet that defines a support base -13- and two plates -14- that are in parallel with one another and perpendicular to the support base -13-. The support base -13- could also be formed exclusively by the horizontal portions of the metal rods, without the need for a sheet.

Each rod is completed by a further bend situated at each of the corners of the support base -13-, thus resulting in a vertical portion. Each vertical portion forms a projection -11-. The projections -11- are arranged so as to form a rectangle. As with all rectangles, the base defines a long side and a short side. As can be seen, the plates -14- are parallel to the long side. The rectangle defined by the projections -11- (or, alternatively, by the support base -13-) is used as a base to define a space for positioning beams.

In particular, the plates -14- divide positioning spaces in the following way:

- a space for positioning a beam arranged in line with the long side, and
- two spaces between the extremity, or end, of each plate -14- and the closest projections -11- for positioning two beams arranged in line (or in parallel) with the short side.

In principle, it is desirable not to require a different type of beam for positioning longitudinally (in line with the long side) or transversally (in line with the short side). This is achieved by making the distance between each end of the plate -15- and the closest projection -11- equal to the distance between plates -14-. In the case of composite beams, in which a lower part is narrower than the upper part, the height of the plates -14- and the length of the projections -11- should preferably be equal to or less than the height of the lower part of the composite beam. In this case, it is likewise preferable for the length of each sheet -14- (i.e. the dimension thereof in the direction of the long side) to be at least the difference in width between the upper part and the lower part of the reference composite beam that is used to design each specific system.

Each of the exemplary sheets has two receptacles -15-, -16-, -15'-, -16'- in the form of recesses situated in the upper edge of each sheet -14-. Each of said recesses is intended to receive a corresponding projection -23- of a beam positioned longitudinally on the head. The number of recesses may be preferably zero, two or four. It may also be a different quantity. As can be seen in the figure, the receptacles -15-, -16-, -15'-, -16'- are located symmetrically with respect to the rectangle which in this case coincides with the position of the lower pin -12-. Each receptacle in each plate is in alignment, in accordance with a line that is parallel to the short side, with a receptacle in the opposite plate.

Figure 2:
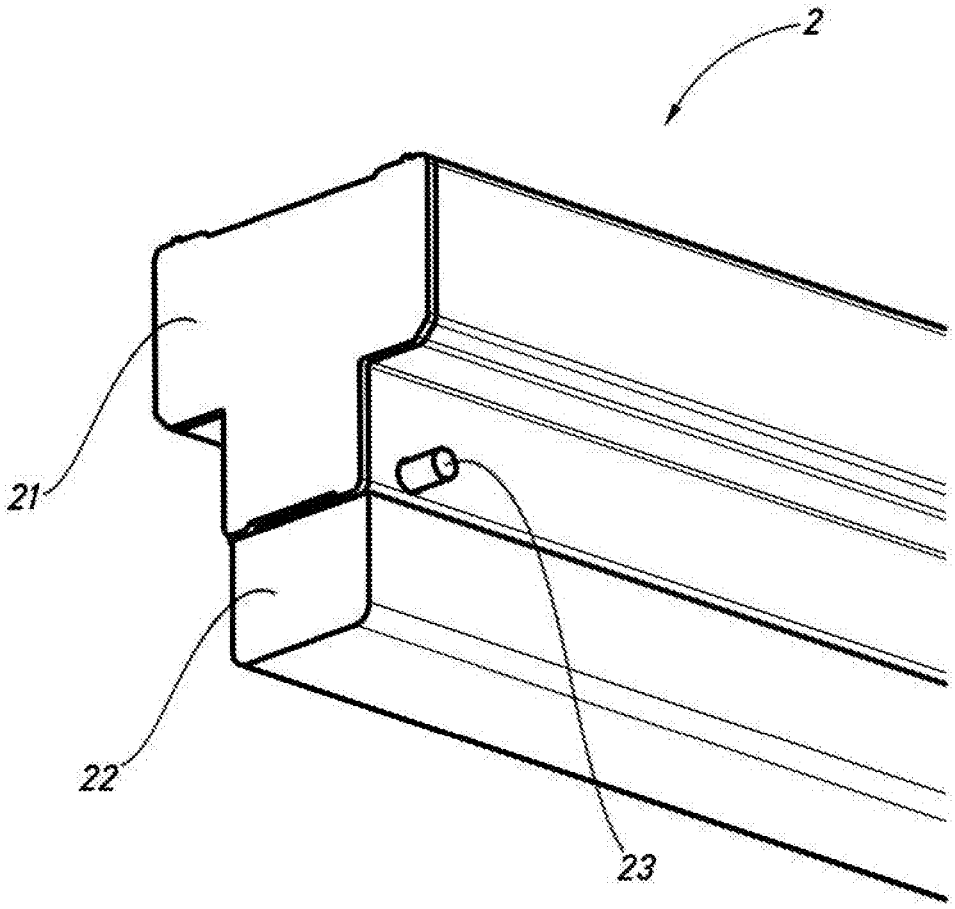
FIG. 2 is a perspective view of an end of a beam which can be used in an exemplary embodiment of a system according to the present invention.

FIG. 2 shows a composite beam -2- comprising, for example, an upper metal part and a lower wooden part. As can be observed, the beam is T-shaped, having a lower part -22- which is narrower (less wide) than the upper part -21-. The beams used in the examples of the following figures are of this type. The beam -2- also has projections -23- on each side. In this case, the projections couple with the receptacles -15-, -16-, -15'-, -16'- of the head in terms of shape and position. In this case, the projections are cylindrical. The projections on each side of the beam are comprised, for example, of a single rod that passes through the beam completely. The position of the rod can be fixed by welding.

This exemplary head allows a variety of beam configurations, only some of which will be described below. In the examples, elements that are the same or similar to those shown in the previous figures have been identified with identical numerals, and therefore will not be described in detail. Additionally, for the sake of clarity, the prop in which the head for a prop -1- would be positioned has not been shown in FIGS. 3 to 12.

Figure 3:
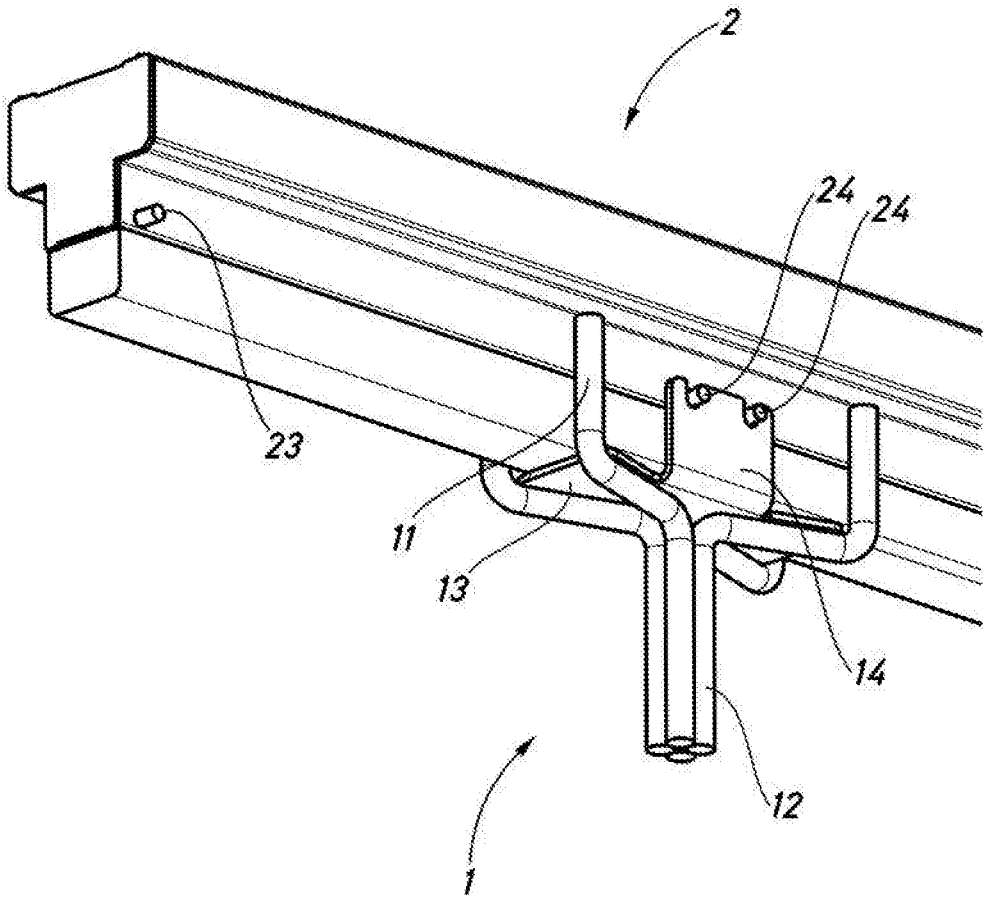
FIG. 3 is a perspective view of an exemplary embodiment of a system according to the present invention.

FIG. 3 shows a beam -2- arranged longitudinally on the head -1-, i.e. in line with the long side. The example shows two projections -24- arranged at an intermediate point along the beam and positioned in the receptacles in the sheet -14-. This allows the beam -2- to be secured. Nevertheless, it is also possible to dispense with said projections -24-.

Figure 4:
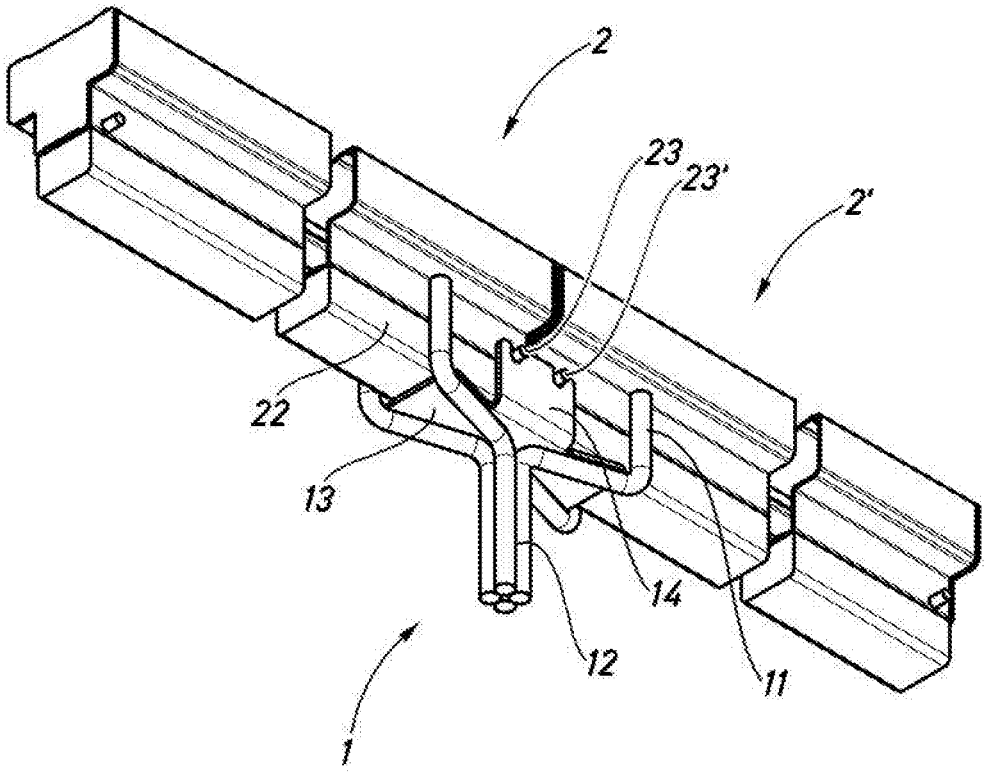
FIG. 4 is a perspective view of a second example of a system according to the present invention, comprising two beams positioned in alignment.
Figure 5:
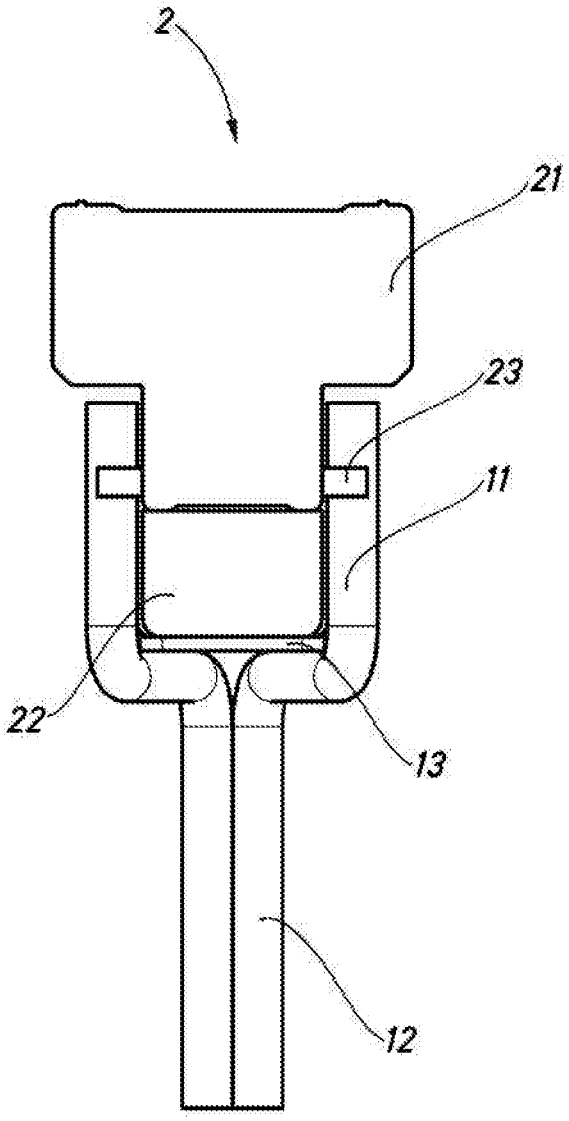
FIG. 5 is an elevated side view of the example of FIG. 4.
Figure 6:
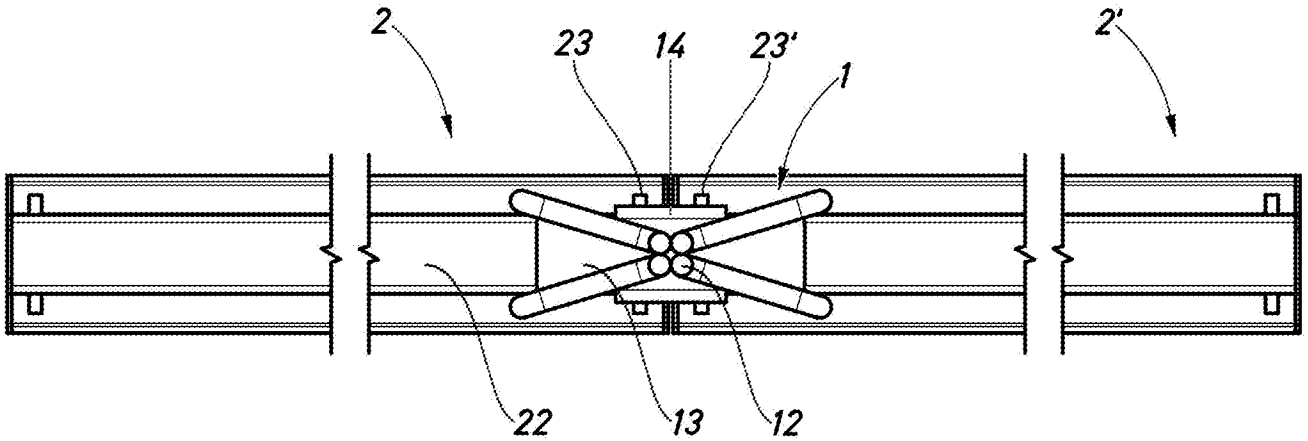
FIG. 6 is a plan view from below of the example of FIGS. 4 and 5.
Figure 7:
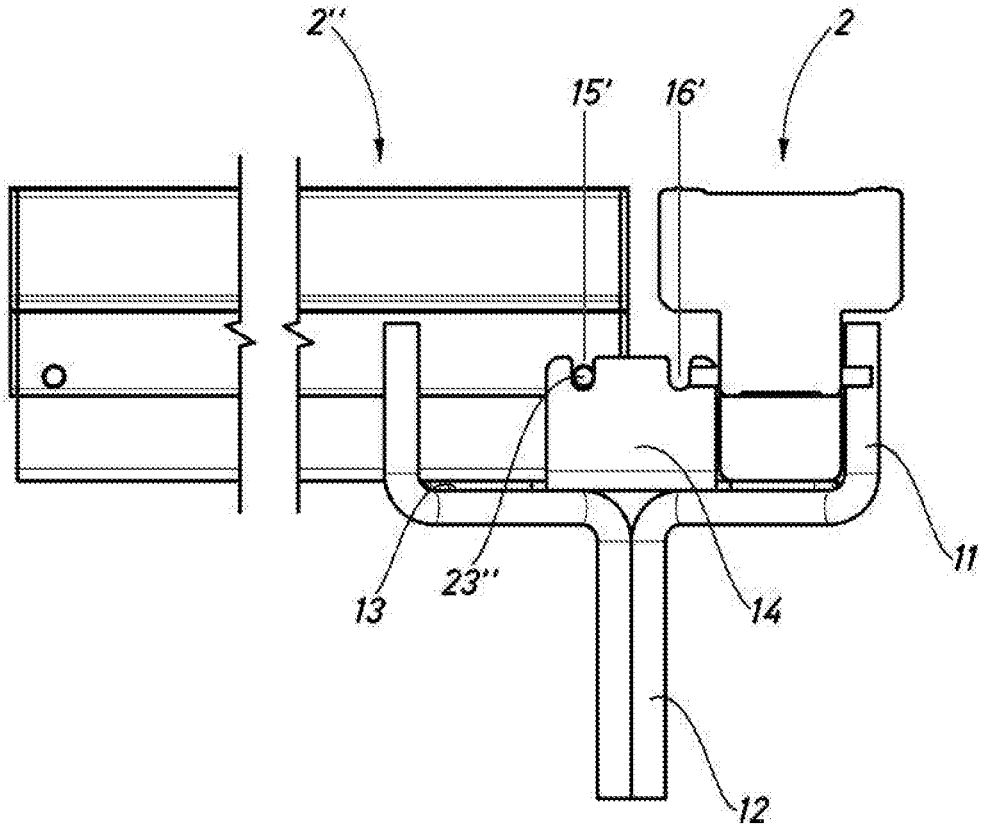
FIG. 7 is an elevated front view of a third exemplary embodiment of a system according to the present invention, comprising two beams arranged perpendicularly to one another.
Figure 8:
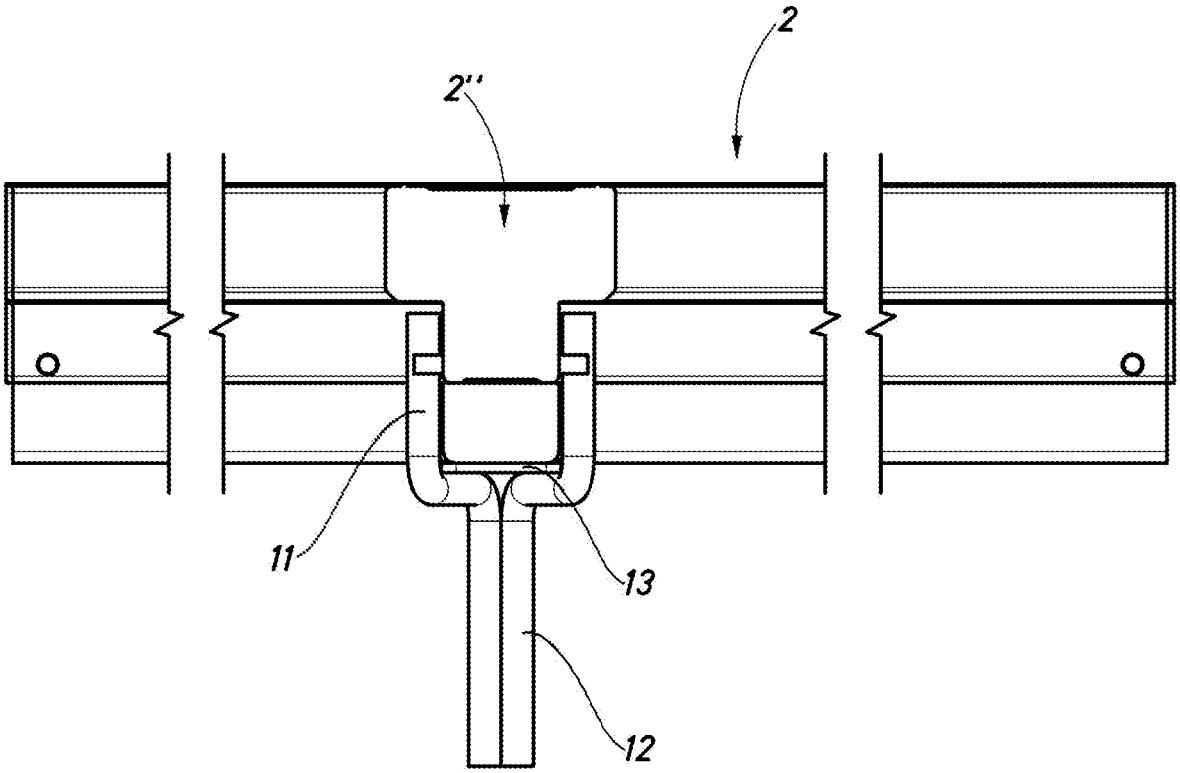
FIG. 8 is an elevated side view of the example of FIG. 7.
Figure 9:
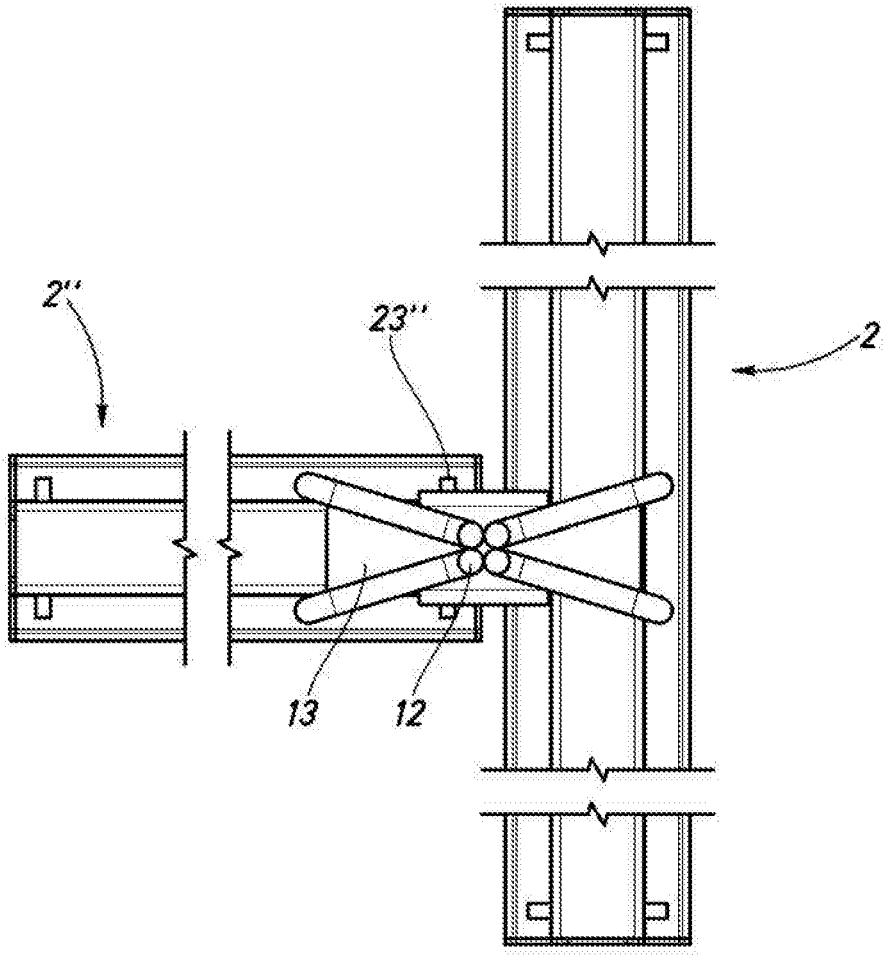
FIG. 9 is a plan view from below of the example of FIGS. 7 and 8.

FIGS. 4 to 6 show two beams -2-, -2'- placed next to one another, one in front of the other. The beams are arranged longitudinally and each one penetrates the beam space of the head. Each projection -23, -23'- of each beam -2-, -2'- is accommodated in a receptacle in a plate -14-; this allows the positioning of the beams to be secured and allows for shocks and displacements.

As is the case in all of the embodiments shown, the projections -11- are formed as arms or fingers. The projections -11- of the examples are used as guides. They can also carry out structural functions, such as restricting movements. The rods that constitute the projections can be made, if desired, from spring steel, for the purpose of imparting resilient functions to said rods.

FIGS. 7 to 10 show an embodiment in which a beam -2"- is arranged longitudinally, as in the previous example, but in which the other beam -2- is arranged transversely, occupying a defined space between one of the ends of the plates -14- and the projections -11-. In this case, receptacles -16'- are not used but those corresponding to the beam -2"- arranged longitudinally are occupied by the corresponding projection -23"-, as is the case with the receptacle -15'-.

Figure 10:
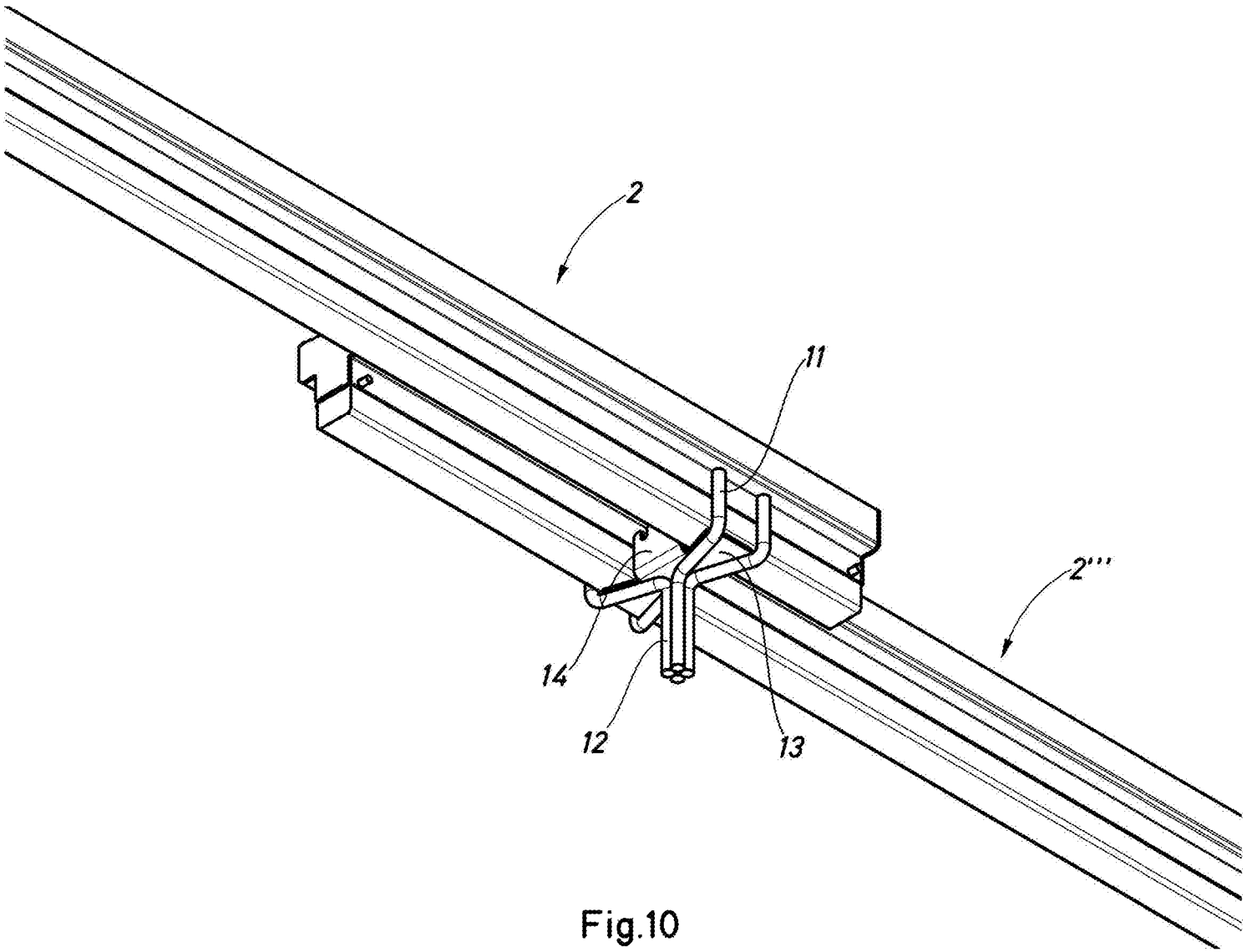
FIG. 10 is a perspective view of a fourth embodiment of a system according to the present invention, comprising two beams arranged in parallel with one another.
Figure 11:
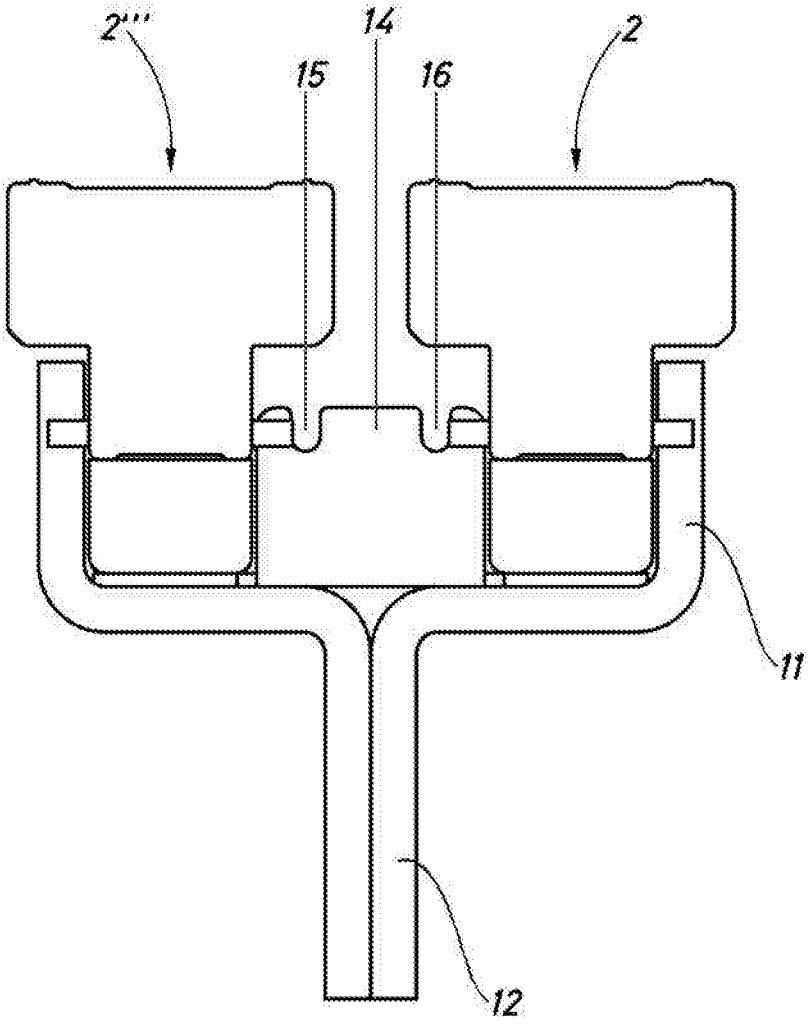
FIG. 11 is an elevated side view of the example of the previous figure.
Figure 12:
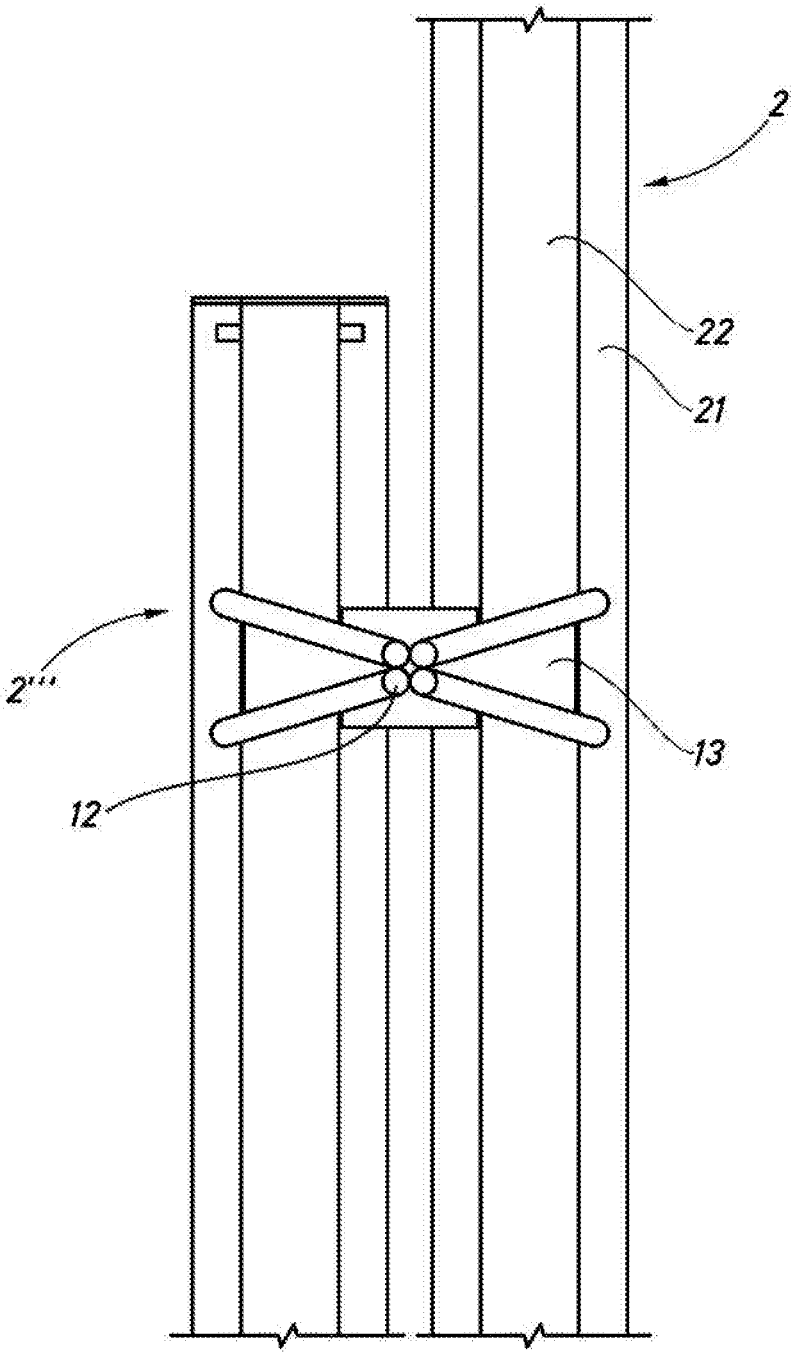
FIG. 12 is a plan view from below of the example of FIGS. 10 and 11.

Finally, FIGS. 10 to 12 show two beams -2-, -2'''- arranged transversely on the head, in parallel with one another, but with an offset in terms of position. If desired, said offset could not exist.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. Therefore, the scope of the present invention includes any variant or equivalent that could be considered covered by the broadest scope of the following claims.

What is claimed is:

1. A head for a formwork prop, comprising:

a lower pin for connecting to the prop, a support base configured to support a plurality of beams having same cross sectional size and shape, four projections arranged so as to form a rectangle that defines a long side and a short side, in which each projection is arranged in respective corners of the rectangle, said rectangle delimiting a beam-receiving region, two plates perpendicular to the support base, wherein:

the plates are arranged in parallel with one another and in parallel with the long side, and configured to leave a space between the plurality of beams to be supported, which is in a direction parallel to the long side of the rectangle, an end of each plate and respective projections are configured to leave a space between the plurality of beams be supported, which is in a direction parallel to the short side of the rectangle, and each plate comprises at least two receptacles configured to couple with beams on the beam-receiving region, wherein the plurality of beams are in parallel and perpendicular with respect to each other.

2. The head according to claim 1, wherein each receptacle in each of the plates is aligned with another receptacle in the parallel plate, along a line that is parallel to the short side.

3. The head according to claim 1, wherein the receptacles are located in an upper edge of each plate.

4. The head according to claim 1, wherein the receptacles are located symmetrically with respect to a center of the rectangle.

5. The head according to claim 1 comprising a base plate which constitutes the support base and to which the plates are connected.

6. The head according to claim 5 comprising a bent sheet which constitutes the parallel plates and the base plate.

7. A formwork prop comprising the head according to claim 1.

8. A formwork system comprising at least one formwork prop according to claim 7 and at least one beam situated in the beam-receiving region.

9. The formwork system according to claim 8, wherein the at least one beam comprises at least one projection that couples with the receptacle or receptacles for securing beams.

10. The formwork system according to claim 9, wherein the at least one projection is cylindrical.

11. A head for a formwork prop, comprising:

a lower pin for connecting to the prop, a support base for beams, four projections arranged so as to form a rectangle that defines a long side and a short side, in which each projection is arranged in a corner of the rectangle, said rectangle delimiting a beam-receiving region, two plates perpendicular to the support base, the plates being arranged in parallel with one another and in parallel with the long side, in such a way that they leave a space for a beam between plates and leave a space for a beam in each case in the space between the ends of the plates and one of the projections, each plate having at least two receptacles for securing beams, and four bent rods which are connected to one another via one of the ends thereof and are separate and parallel in the other, one connected portion of rods constituting the pin and each of the separate and parallel ends constituting one of the projections.

12. A formwork system, comprising at least one formwork prop comprising a formwork head and at least one beam situated in a beam-receiving region of the formwork head, said head comprising a lower pin for connecting to the prop, a support base for beams, and four projections arranged so as to form a rectangle that defines a long side and a short side, in which each projection is arranged in a corner of the rectangle, said rectangle delimiting the beam-receiving region, two plates perpendicular to the support base, the plates being arranged in parallel with one another and in parallel with the long side, in such a way that they leave a space for a beam between plates and leave a space for the beam in each case in the space between the ends of the plates and one of the projections, each plate having at least two receptacles for securing beams, wherein the beam comprises at least one cylindrical projection that couples with the receptacle or receptacles for securing beams, wherein the beam comprises two projections, one on each side of the beam, the longitudinal axis of the cylinders of the two projections being aligned.

* * * * *